US005307522A

United States Patent [19]

Throneburg et al.

[11] Patent Number: 5,307,522

[45] Date of Patent: May 3, 1994

[54] SNOWBOARDING SOCK

[75] Inventors: James L. Throneburg, 100 Fox Creek Rd., Statesville, N.C. 28677; George L. Thorneburg, Statesville, N.C.

[73] Assignee: James L. Throneburg, Statesville, N.C.

[21] Appl. No.: 832,400

[22] Filed: Feb. 7, 1992

[51] Int. Cl.[5] ..... A41B 11/00

[52] U.S. Cl. ..... 2/239; 2/241; 66/118 R; 66/182; 66/185

[58] Field of Search ..... 2/239, 241, 240; 66/178 A, 178 R, 182, 185, 188, 194

[56] References Cited

U.S. PATENT DOCUMENTS

| | | | |
|---|---|---|---|
| 2,800,782 | 7/1957 | Bridges | 66/182 |
| 3,793,851 | 2/1974 | Thorneburg | 66/185 |
| 3,796,067 | 3/1974 | East | 66/178 |
| 4,172,370 | 10/1979 | Safrit et al. . | |
| 4,194,249 | 3/1980 | Thorneburg | 2/239 |
| 4,255,949 | 3/1981 | Thorneburg | 66/185 |
| 4,263,793 | 4/1981 | Safrit et al. | 66/185 |
| 4,373,361 | 2/1983 | Thorneburg | 66/178 R |
| 4,467,626 | 8/1984 | Coble et al. | 66/178 R |
| 4,589,266 | 5/1986 | Oakley, Jr. et al. . | |
| 4,589,267 | 5/1986 | Barbee . | |
| 4,732,015 | 3/1988 | Abrams et al. | 66/182 |

*Primary Examiner*—Andrew M. Falik

*Assistant Examiner*—Gloria Hale

*Attorney, Agent, or Firm*—Bell, Seltzer, Park & Gibson

[57] ABSTRACT

A cushioning pad of heavy fabric thickness (P-2), including double terry loops (T-1 and T-2), is formed in the high pad area (12) at the medial portion of the rear of the leg (L) to provide cushioning characteristics in this area to protect the rear of the lower leg of the wearer from chafing by the upper edge of a snowboarding boot. A pad of maximum fabric thickness (P-3), including triple terry loops (T-1, T-2 and T-3) is provided in the high splice area (13) above the heel (14) and defines a locking pad to force the wearer's foot forwardly into the boot when the foot is inserted into the boot to provide a firm fit of the foot of the wearer in the boot. Pads of heavy fabric thickness (P-2) are provided in the ball (18) and toe (15) to cushion the toes of the wearer and to absorb shocks in the ball area when landing after completing flip-over operations or maneuvers. A cushioning pad of medium fabric thickness (P-1), including single terry loops (T-1), is provided in the front half of the leg L and the instep of the foot F to cushion and prevent chafing of the upper front edge of the boot and the upper portion of the boot. optionally, pads of medium fabric thickness (P-1) may be provided in the heel (14) and the lower splice area (16) to cushion the heel of the wearer.

15 Claims, 2 Drawing Sheets

SNOWBOARDING SOCK

FIELD OF THE INVENTION

This invention relates generally to a sock particularly adapted for wear with snowboarding boots when snowboarding to facilitate evaporation of moisture from the foot, prevent shifting of the foot in the boot and for cushioning selected areas of the leg and foot by providing pads of different fabric thickness in selected areas of the leg and foot of the wearer, and more particularly to such a sock wherein cushioning pads of medium fabric thickness are provided by forming a first set of terry loops (single terry loops) in the front half of the leg, the instep of the foot and optionally in the heel and low splice area extending below the heel, while cushioning pads of heavy fabric thickness are provided by forming both first and second sets of terry loops (double terry loops) in a high pad area in the medial portion of the rear of the leg, in the ball, and in the toe, and while a cushioning pad of maximum fabric thickness is provided by forming first, second and third sets of terry loops (triple terry loops) in the high splice area above the heel.

BACKGROUND OF THE INVENTION

U.S. Pat. No. 4,373,361 discloses a ski sock with additional yarn knit in selected portions of the sock to form thickened fabric areas extending along selected portions of the front and rear of the leg. In certain embodiments of the sock disclosed in my prior patent, the thickened fabric areas form pads of medium fabric thickness by knitting a first set of terry loops, and pads of heavy fabric thickness by knitting both first and second sets of terry loops. In each embodiment of the ski sock of my prior patent, thickened fabric areas extend along the front portion of the leg to cushion and protect the front portion of the leg of the wearer from chafing and from pressure exerted against the leg by the front and upper edge of the ski boot. The ski sock of my prior patent is perfectly satisfactory for use when normal skiing maneuvers are performed by a person wearing conventional relatively stiff ski boots. However, it has been found that this ski sock does not provide the required firm fit and all of the desired padding and cushioning characteristics when the wearer is snowboarding. A person engaged in snowboarding normally wears boots that are much more flexible than a conventional ski boot, and frequently performs backward flips and other unusual aerobatic maneuvers. The unusual maneuvers performed during snowboarding require that the snowboarding boot be firmly positioned on the foot and leg of the wearer, notwithstanding the flexibility of the boot, and that the sock provide sufficient cushioning characteristics to absorb shocks imparted to the foot and lower leg of the wearer during such maneuvers.

SUMMARY OF THE INVENTION

With the foregoing in mind, it is an object of the present invention to provide a snowboarding sock which includes auxiliary yarn knit in plated relationship with the body yarn in a high splice area above the heel and forms terry loops to define a locking pad of greater fabric thickness than the fabric thickness of the adjacent heel and leg areas so that the locking pad forces the foot of the wearer forwardly in the boot to provide a firm fit and prevent shifting of the foot in the snowboarding boot.

It is a further object of the present invention to provide a snowboarding sock which includes auxiliary yarn knit in plated relationship with the body yarn in a high pad area spaced above the heel and extending around the rear of the leg. The auxiliary yarn forms terry loops in the high pad area and a greater fabric thickness than the fabric thickness of areas of the leg surrounding the high pad area to protect the rear of the leg of the wearer from chafing when pressure is exerted against the leg of the wearer by the upper rear edge of the snowboarding boot.

The snowboarding sock of the present invention includes cushioning pads of heavy fabric thickness (double terry loops) in the high pad area in the medial portion of the rear of the leg, the ball area of the foot, and the toe. The cushioning pad of heavy fabric thickness in the high pad area at the medial portion of the rear of the leg provides cushioning characteristics in this area to protect the rear of the lower leg of the wearer from chafing by the rear upper edge of the snowboarding boot when the wearer pulls the front of the snowboard up to begin a backwards flip-over maneuver. A cushioning pad of maximum fabric thickness (triple terry loops) is provided in the high splice area above the heel and functions as a locking pad so that the wearer's foot is forced forwardly into the ski boot when the snowboarding boot is pulled onto the foot to provide a firm fit of the foot of the wearer in the boot. The cushioning pads of heavy fabric thickness (double terry loops) in the ball and toe are provided to cushion the toes of the wearer and to absorb shocks in the ball area when landing after completing flip-over operations or maneuvers. The cushioning pads of heavy fabric thickness (double terry loops) in the ball and toe also provide extra warmth and insulation in these areas.

The snowboarding sock of the present invention is knit throughout of at least one base or body yarn and a first auxiliary yarn knit in plated relationship with the body yarn. The first auxiliary yarn forms a first set of terry loops (single terry loops) in the front half of the leg and the instep, and optionally in the heel and low splice area below the heel, thereby providing cushioning pads of medium fabric thickness in these areas. A second auxiliary yarn is knit in plated relationship with the body yarn and the first auxiliary yarn and forms first and second sets of terry loops (double terry loops) in the high pad area in the medial portion of the rear half of the leg, the ball area, and the toe of the sock to provide cushioning pads of heavy fabric thickness in those areas so that heavy cushioning is provided thereby. A third auxiliary yarn is knit in plated relationship with the body yarn, the first auxiliary yarn, and the second auxiliary yarn and forms three sets of terry loops (triple terry loops) in the high splice area above the heel defining the locking pad.

The cushioning pads of medium fabric thickness (single terry loops) in the front half of the leg and the instep of the foot encompass less than half of the wales in the leg and more than one-fourth of the wales in the leg. The cushioning pads of heavy fabric thickness (double terry loops) in the high pad area, and in the ball, as well as the cushioning pad of maximum fabric thickness (triple terry loops) defining the locking pad in the high splice area above the heel, encompass half of the wales in the corresponding leg and foot and define opposite side panels devoid of terry loops and being knit of the body yarn and the first auxiliary yarn in plated relationship. These panels which are devoid of terry loops and which extend along opposite sides of the socks form channels to facilitate removal and evaporation of moisture from the foot. These channels along opposite sides of the sock also provide ventilation and tend to reduce the bulk of the sock. The second auxiliary yarn forming the second set of terry loops in the high pad area and the ball, as well as the third auxiliary yarn forming the third set of terry loops in the locking pad in the high splice area, are cut at opposite sides of the cushioning pads and extend inside of the leg and foot of the sock and adjacent one side of the opposite moisture control side panels which are devoid of terry loops.

BRIEF DESCRIPTION OF THE DRAWINGS

Other objects and advantages will appear as the description proceeds when taken in connection with the accompanying drawings, in which —

DESCRIPTION OF THE ILLUSTRATED EMBODIMENT

Figure 1:
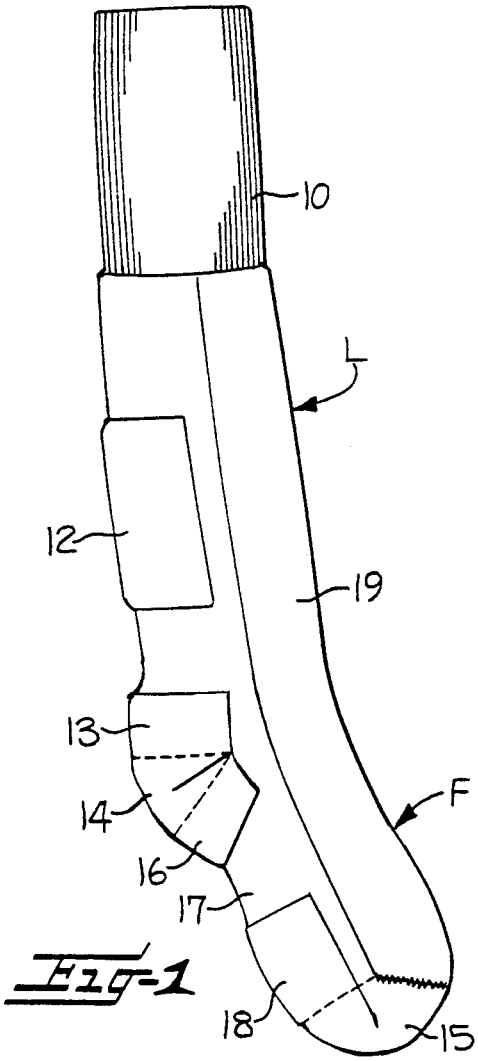
FIG. 1 is a side elevational view of the snowboarding sock of the present invention, being shown in flattened condition and illustrating the areas in which the cushioning pads of thickened fabric areas are provided in the sock.
Figure 2:
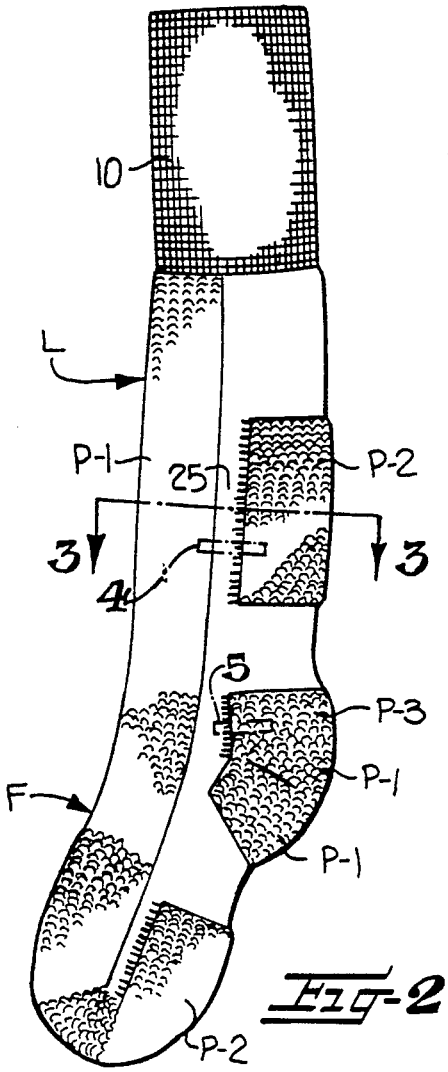
FIG. 2 is a view similar to FIG. 1 but showing the sock in everted condition and illustrating the positions of the padded cushion terry loop areas in the sock.
Figure 3:
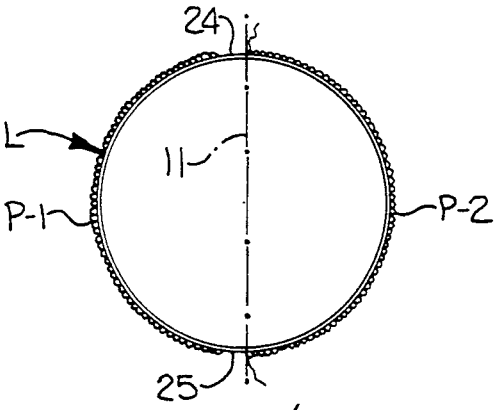
FIG. 3 is a somewhat schematic transverse horizontal sectional view taken substantially along the line 3—3 in FIG. 2 and showing the sock in a circular condition.

As illustrated in FIGS. 1 and 2, the present snowboarding sock includes an upper cuff 10 which may be of a true rib or mock rib construction. The cuff 10 is integrally knit with the upper portion of the leg, broadly indicated at L, and which includes a front half and a rear half, illustrated in FIG. 3 as being divided by a center line 11. A high pad area 12 (FIG. 1) is provided in the medial portion of the rear of the leg L and a high splice area 13 is provided in the lower portion of the rear of the leg L. The lower edge of the high pad area 12 is spaced above the upper edge of the high splice area 13 by about one-half the overall length of the high pad area 12. The high pad area 12 is positioned to be contacted by the upper edge of the snowboarding boot. The leg L is integrally knit with a foot, broadly indicated at F, and including a heel pocket 14, a toe 15, and a sole extending between the heel 14 and the toe 15. The sole includes a low splice area 16 (FIG. 1) extending below the heel 14, an arch area 17, and a ball area 18. A front pad area 19 extends along the front of the leg L and along the instep area of the upper portion of the foot F.

Figure 4:
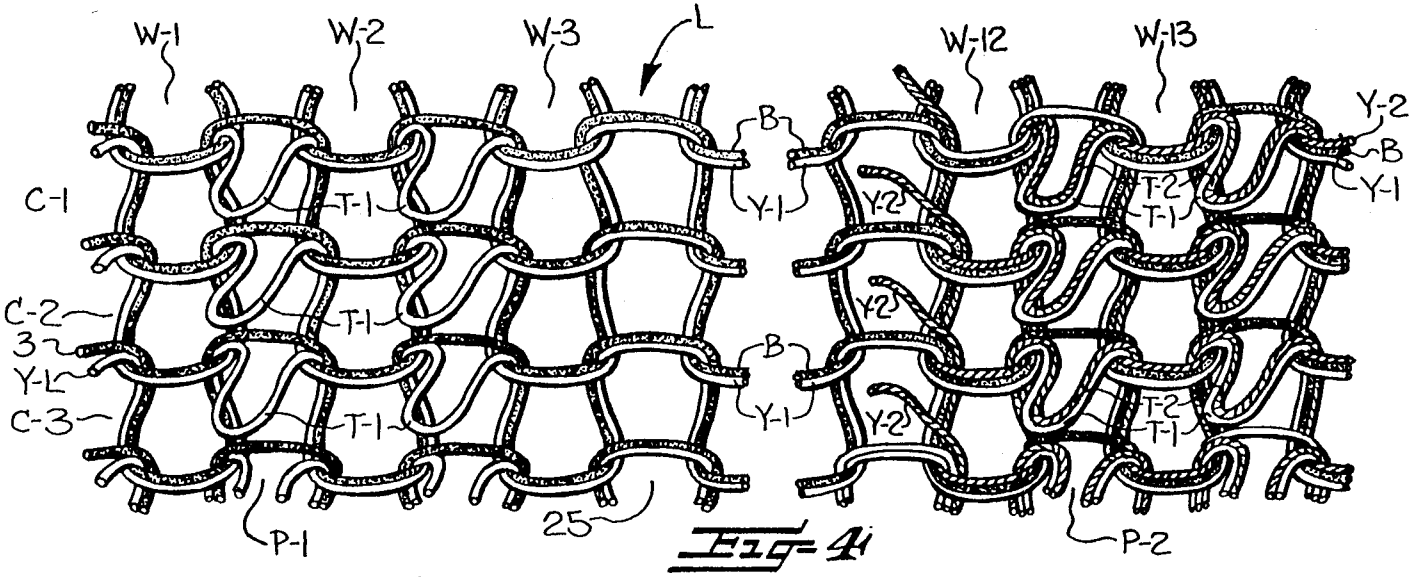
FIG. 4 is a greatly enlarged elevational view of the small area of the fabric taken substantially in the area of the dotted rectangle 4 in FIG. 2, and with some of the wales being omitted in the opposite side panels which are devoid of terry loops.

As illustrated in the enlarged fragmentary fabric shown in FIG. 4, the leg L and foot F of the sock are knit throughout of at least one body yarn B, shown speckled for ease of identification, and a first auxiliary yarn Y-1, shown plain, is knit in plated relationship with the body yarn B. The body yarn B is preferably hydrophobic yarn, such as stretch nylon, while the first auxiliary body yarn Y-1 is preferably a hydrophilic yarn, such as a blend of wool and polyester. The body yarn B is knit in plated relationship with the first auxiliary body yarn Y-1 so as to be positioned primarily on the outer surface of the sock while the first auxiliary yarn Y-1 is positioned primarily on the inner surface of the sock. The leg L and foot F include a front half covering the front of the leg and the top of the foot of the wearer and a rear half covering the rear of the leg and the bottom of the foot of the wearer.

As illustrated in the left-hand portion of FIG. 4, the first auxiliary yarn Y-1 is knit in plated relationship with the body yarn B in the needle wales and forms a first set of terry loops T-1 in the sinker wales, as illustrated between the wales W-1, W-2 and W-2, W-3 to provide a cushioning pad P-1 of medium fabric thickness (single terry loops) extending throughout the front pad area 19 along the front half of the leg L and the instep of the foot F (FIG. 2). The medium fabric thickness pad P-1 encompasses less than half of the wales in the leg L and foot F and more than one-fourth of the wales of the leg L and foot F to provide opposite side panels 24, 25 (FIG. 3) which are devoid of terry loops and which are knit of the body yarn B and the first auxiliary yarn Y-1 in plated relationship. The opposite side panels 24, 25 preferably encompass about eight wales each. These opposite side panels 24, 25 act as moisture control channels to facilitate removal and evaporation of moisture from the foot, provide ventilation and reduce the bulk of the sock. The opposite side panels 24, 25 extend throughout the length of opposite sides of the sock and define moisture control channels which facilitate the movement and evaporation of moisture from the foot of the wearer, The first auxiliary yarn Y-1 is also preferably knit in plated relationship with the body yarn B and forms a first set of terry loops T-1 in the heel 14 and the low splice area 16 so that pads of medium fabric thickness, as indicated at P-1 in FIG. 2, are also formed in these areas.

A second auxiliary yarn Y-2 (shown cross-hatched in FIGS. 4 and 5) is knit in plated relationship with the body yarn B and the first auxiliary yarn Y-1 and forms a second set of terry loops T-2, as illustrated in the right-hand portion of FIG. 4, to provide cushioning pads of heavy fabric thickness (double terry loops), as indicated at P-2 in FIG. 2. The cushioning pads of heavy fabric thickness P-2 are formed in the high pad area 12 in the medial portion of the rear half of the leg L, in the ball area 18 and in the toe 15.

Figure 5:
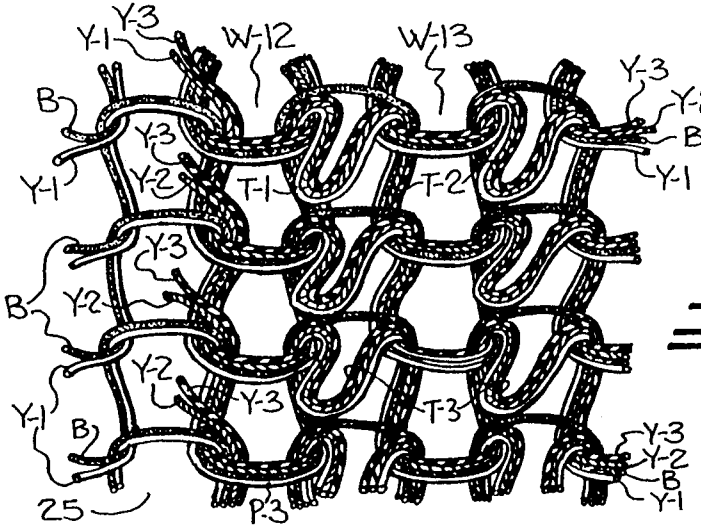
FIG. 5 is a view similar to FIG. 4 but being taken in the area of the dotted rectangle 5 in FIG. 2.

A third auxiliary yarn Y-3 (shown striped in FIG. 5) is knit in plated relationship with the body yarn B, the first auxiliary yarn Y-1, and the second auxiliary yarn Y-2 and forms a third set of terry loops T-3, as illustrated in FIG. 5, to provide a cushioning pad of maximum fabric thickness (triple terry loops), as indicated at P-3 in FIG. 2. The cushioning pad of maximum fabric thickness P-3 defines a locking pad in the high splice area 13 above the heel 14.

Thus, a single set of terry loops T-1 is formed in the pads of medium fabric thickness P-1 in the area 19 extending along the front half of the leg L and foot F, in the heel 14, and low splice area 16 while both first and second sets of terry loops T-1 and T-2 are formed in the cushioning pads of heavy fabric thickness P-2 in the high pad area 12 of the leg L, the ball 18, and the toe 15. First, second and third sets of terry loops (T-1, T-2 and T-3) are formed in the cushioning locking pad P-3 of maximum fabric thickness in the high splice area 13 above the heel 14. As illustrated in FIG. 2, the right-hand portion of FIG. 4, and in FIG. 5, the second auxiliary yarn Y-2 and the third auxiliary yarn Y-3 are each cut at opposite sides of the cushioning pads of heavy fabric thickness P-2 and the cushioning pad of maximum fabric thickness P-3 so that the cut ends extend inside of the leg L and foot F of the sock and adjacent opposite sides of the opposite side panels 24, 25.

Thus, the present snowboarding sock provides cushioning pads of medium fabric thickness P-1 (single terry loops) by forming a first set of terry loops T-1 in the front half of the leg L, the instep of the foot F, and optionally in the heel 14 and low splice area 16. Cushioning pads of heavy fabric thickness P-2 (double terry loops) are provided by forming both first and second sets of terry loops T-1 and T-2 in the high pad area 12 in the medial portion of the rear of the leg L, in the ball area 18 and in the toe 15. A cushioning pad of maximum fabric thickness P-3 (triple terry loops) is provided by forming first, second and third sets of terry loops (T-1, T-2 and T-3) in the locking pad in the high splice area 13 above the heel 14.

The cushioning pad of heavy fabric thickness P-2 in the high pad area 12 at the medial portion of the rear of the leg L provides cushioning characteristics in this area to protect the rear of the leg of the wearer from chafing when pressure is exerted against the leg of the wearer by the upper rear edge of the snowboarding boot. The cushioning pad of maximum fabric thickness P-3 in the high splice area 13 above the heel 14 defines the locking pad of greater fabric thickness than the fabric thickness of the adjacent heel and leg areas so that the wearer's foot is forced forwardly into the boot when the foot is inserted into the boot to provide a firm fit of the foot of the wearer in the boot. The cushioning pads of heavy fabric thickness P-2 in the ball 18 and the toe 13 are provided to cushion the toes of the wearer and to absorb shocks in the ball area when landing after completing a flip-over operation or maneuver. The cushioning pad of medium fabric thickness P-1 in the front half of the leg L and foot -F cushions and protects the front of the leg of the wearer to prevent chafing by the upper front edge of the boot and the upper portion of the boot during use. The optional pads of medium fabric thickness P-1 in the heel 14 and low splice area 16 provide cushioning characteristics in these areas to cushion the heel of the wearer.

In the drawings and specification, there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A sock particularly adapted for wear with a flexible snowboarding boot when snowboarding and being adapted to provide a firm fit and prevent shifting of the foot in the boot, said sock comprising (a) an integrally knit leg and foot and being knit of at least one body yarn, (b) said foot including a heel and a high splice area extending above said heel, (c) auxiliary yarn knit in plated relationship with said body yarn in said high splice area and forming terry loops in said high splice area, said terry loops defining a locking pad a greater fabric thickness than the fabric thickness of the adjacent heel and leg areas so that said locking pad forces the foot of the wearer forwardly in the boot to provide a firm fit and prevent shifting of the foot in the boot, and (d) including auxiliary yarn knit in plated relationship with said body yarn in a high pad area spaced above said high splice area and extending around the rear of the leg of said sock, said auxiliary yarn forming terry loops in said high pad area and providing a greater fabric thickness than the fabric thickness of areas of said leg surrounding said high pad area to protect the rear of the leg of the wearer from chafing when pressure is exerted against the leg of the wearer by the upper rear edge of the snowboarding boot.

2. A sock particularly adapted for wear with a flexible snowboarding boot when snowboarding and being adapted to cushion selected areas of the leg and foot by providing pads of different fabric thickness in selected areas of the leg and foot of the wearer, said sock comprising (a) an integrally knit leg and foot knit of at least one body yarn, (b) said leg and foot including a front half covering the front of the leg and the top of the foot of the wearer, and a rear half covering the rear of the leg and the bottom of the foot of the wearer, said rear half of said leg including a high pad area in the medial portion thereof, and a high splice area in the lower portion thereof, said foot including a heel, a low splice area below said heel, an arch area, a ball area, an instep above said ball and arch areas, and a toe, (c) a first auxiliary yarn knit in plated relationship with said body yarn and forming a first set of terry loops in said front half of said leg, said instep of said foot, said high pad area of said leg, said high splice area, said ball, and said toe to provide cushioning pads of medium fabric thickness in said areas, (d) a second auxiliary yarn knit in plated relationship with said body yarn and said first auxiliary yarn and forming a second set of terry loops in said high pad area, said high splice area, said ball, and said toe to provide cushioning pads of heavy fabric thickness in these areas so that heavy cushioning is provided thereby, and (e) a third auxiliary yarn knit in plated relationship with said body yarn, said first auxiliary yarn, and said second auxiliary yarn and forming a third set of terry loops in said high splice area to provide a cushioning pad of maximum fabric thickness in this area so that maximum cushioning is provided thereby.

3. A sock according to claim 2 wherein said first auxiliary yarn also forms a first set of terry loops in said heel.

4. A sock according to claim 3 wherein said first auxiliary yarn also forms a first set of terry loops in said low splice area below said heel.

5. A sock according to claim 2 wherein said pads of medium fabric thickness in the front half of said leg and said instep of said foot encompass less than half of the wales in the leg and foot and more than one-fourth of the wales in the leg and foot.

6. A sock according to claim 5 wherein said pads of heavy fabric thickness in said high pad area, and said ball, and said pad of maximum fabric thickness in said high splice area encompass half of the wales in the corresponding leg and foot and define opposite side panels devoid of terry loops and knit of said body yarn and said first auxiliary yarn in plated relationship.

7. A sock according to claim 6 wherein said second auxiliary yarn forming said second set of terry loops in said high pad area, said high splice area, and said ball is cut at opposite sides of said cushioning pads of heavy and maximum fabric thickness and extends inside of said leg and said foot of said sock and adjacent opposite sides of said opposite side panels.

8. A sock according to claim 2 wherein said high pad area includes a lower edge spaced above the upper edge of said high splice area by about one-half the overall length of said high pad area.

9. A sock particularly adapted for wear with a snowboarding boot when snowboarding and being adapted to cushion selected areas of the leg and foot by providing pads of single terry loops, double terry loops, and triple terry loops in selected areas of the leg and foot of the wearer, said sock comprising (a) an integrally knit leg and foot and being knit throughout of at least one body yarn, (b) said leg and foot including a front half covering the front of the leg and the top of the foot of the wearer, and a rear half covering the rear of the leg and the bottom of the foot of the wearer, said rear half of said leg including a high pad area in the medial portion thereof, and a high splice area in the lower portion thereof, said foot including a heel, a low splice area below said heel, an arch area, a ball area, an instep above said ball and arch areas, and a toe, (c) a first auxiliary yarn knit in plated relationship with said body yarn throughout said sock and forming single terry loops in said front half of said leg, and said instep of said foot to provide cushioning pads of single terry loops in these areas, (d) a second auxiliary yarn knit in plated relationship with said body yarn and said first auxiliary yarn and forming double terry loops in said high pad area, said toe and said ball to provide cushioning pads of double terry loops in these areas, and (e) a third auxiliary yarn knit in plated relationship with said body yarn, said first auxiliary yarn, and said second auxiliary yarn and forming triple terry loops in said high splice area to define a locking cushioning pad of triple terry loops in said high splice area.

10. A sock according to claim 9 wherein said first auxiliary yarn also forms single terry loops in said heel.

11. A sock according to claim 10 wherein said first auxiliary yarn also forms single terry loops in said low splice area.

12. A sock according to claim 9 wherein said cushioning pads of single terry loops in the front half of said leg and said instep of said foot encompass less than half of the wales in the leg and foot and more than one-fourth of the wales in the leg and foot.

13. A sock according to claim 12 wherein said cushioning pads of double terry loops in said high pad area, and said ball, and said cushioning pad of triple terry loops in said high splice area encompass half of the wales in the corresponding leg and foot and define opposite side panels devoid of terry loops and knit of said body yarn and said first auxiliary yarn in plated relationship.

14. A sock according to claim 13 wherein said second auxiliary yarn forming said cushioning pads of double terry loops in said high pad area, and said ball, and said third auxiliary yarn forming said cushioning pad of triple terry loops in said high splice area are each cut at opposite sides of said cushioning pads of double and triple terry loops and extend inside of said leg and said foot of said sock and adjacent opposite sides of said opposite side panels.

15. A sock according to claim 9 wherein said high pad area includes a lower edge spaced above the upper edge of said high splice area by about one-half the overall length of said high pad area.

* * * * *